US005105758A

United States Patent [19]

Kozak

[11] Patent Number: 5,105,758

[45] Date of Patent: Apr. 21, 1992

[54] CATCH PAN FOR USE IN CURTAIN COATING APPARATUS

[75] Inventor: Stephen J. Kozak, Webster, N.Y.

[73] Assignee: Eastman Kodak Company, Rochester, N.Y.

[21] Appl. No.: 662,691

[22] Filed: Mar. 1, 1991

Related U.S. Application Data

[62] Division of Ser. No. 564,277, Aug. 8, 1990, Pat. No. 5,017,408.

[51] Int. Cl.[5] ..... B05C 5/00

[52] U.S. Cl. ..... 118/300; 118/DIG. 4; 427/420

[58] Field of Search ..... 427/420; 118/DIG. 4, 118/300; 220/306, 9.1, 85 B

[56] References Cited

U.S. PATENT DOCUMENTS

| | | | |
|---|---|---|---|
| 3,508,947 | 4/1970 | Hughes | 117/34 |
| 3,532,244 | 10/1970 | Yates, Jr. | 220/306 X |
| 3,749,276 | 7/1973 | Davis | 220/306 |
| 4,471,880 | 9/1984 | Taylor et al. | 220/306 |
| 4,559,896 | 12/1985 | Bossard et al. | 118/300 |
| 4,647,482 | 3/1987 | Degrauwe et al. | 427/420 |
| 4,819,824 | 4/1989 | Longbottom et al. | 220/306 X |
| 4,830,887 | 5/1989 | Reiter | 427/420 |
| 4,851,268 | 7/1989 | Kozate | 430/939 |
| 4,922,851 | 5/1990 | Morikawa et al. | 118/324 |

*Primary Examiner*—Shrive Beck
*Assistant Examiner*—Alain Bashore
*Attorney, Agent, or Firm*—Charles E. Snee, III

[57] ABSTRACT

A novel catch pan is disclosed for use in apparatus for coating of a support or moving web using curtain coating method and apparatus. The catch pan is used during start-up and shut-down. In use the catch pan is positioned between first and second edge guides and in close proximity to a support. The catch pan includes a main catch pan surface and first and second opposing sides each having a resilient, flexible shim projecting out along the upper edge thereof and into contact with the first and second edge guides, respectively. Each shim strips liquids from the adjacent edge guide, and then directs such liquids onto the catch pan surface during start-up and shut-down without the deposition of excess liquids on the support, web, or coating roller. Means are provided for retracting the catch pan and controlling the falling curtain during start-up, and for inserting the catch pan for intercepting the falling curtain during shut-down.

5 Claims, 4 Drawing Sheets

CATCH PAN FOR USE IN CURTAIN COATING APPARATUS

RELATED APPLICATIONS

This application is a division of application Ser. No. 564.277, filed Aug. 8, 1990, now U.S. Pat. No. 5,017,408.

FIELD OF THE INVENTION

The present invention relates to catch pans for use in apparatus for coating objects or webs by the curtain coating method, and, more particularly, to an improved curtain coating start/finish catch pan for use in the manufacture of photographic materials such as photographic film and paper.

BACKGROUND OF THE INVENTION

In curtain coating, a travelling web or object is coated by a free-falling curtain of coating liquid that is caused to impinge onto the travelling web or object to form a layer thereon. The width of the free-falling curtain can be maintained by edge guides that are in adherent, i.e., wetting, contact with the lateral boundaries or edges of the curtain. For example, in aqueous solution systems for photographic products it is known to use a curtain coating method which comprises the simultaneous application of silver halide emulsions containing gelatin as a binder by using a slide hopper coating apparatus to form a multilayer photographic film or paper. A moving web is coated by a free-falling curtain of coating composition wherein the multilayer composition is formed on the slide hopper and caused to fall as a curtain and impinge the moving web to form the coated layer thereon. The formation of a composite of a plurality of distinct layers on a moving web is described in U.S. Pat. No. 3,508,947, which relates particularly to the manufacture of multilayer photographic materials such as photographic film and paper.

U.S. Pat. No. 3,508,947 describes a method and apparatus commonly used to start-up a continuous curtain coating process as shown in FIG. 1 herein. As shown in FIG. 1 herein, a flat curtain deflector 16, 22 is mounted in position 21 or 23 so it can be pivoted or slid into position. During preparation for coating, the deflector 16, 22 diverts the free fall of the curtain 12 fluids to flow down the deflector surface and into a catch pan 24. The coating process is started after establishing the stability of the curtain 12 and bringing the web 18 to a desired coating speed. The curtain deflector 16, 22 is then retracted by pivoting or sliding it away from the falling curtain 12 to allow the curtain 12 liquids to impinge onto the moving web 18. Although the curtain deflector 16, 22 can be located on either the front or back side of the falling curtain 12 as shown in positions 21 and 23, respectively, use of a deflector 16, 22 in this manner results in the deposition of excess coating liquids on the moving web 18.

Deposits of excess coating liquids on the moving web 18 often occur in amounts that result in the generation of large quantities of extremely costly waste, e.g., for each occurence it is not unusual to have more than a thousand linear meters of wasted coated photographic material. In addition, areas of excess coating liquids deposited on the web will often transfer from the web onto coating roller 20, the machine rollers used in transporting the moving web 18, and also the web wind-up end of the machine. Furthermore, it should be appreciated that each new start-up of a coating process is susceptible to incurring the same problems.

U.S. Pat. No. 4,851,268 describes a curtain coating start-up method and apparatus comprising a catch pan 30 as shown in FIG. 2 herein. The catch pan 30 includes a primary lip 32 and secondary lip 44 which, during retraction in the start-up phase of the curtain coating process, prevents the deposit of excess coating liquids onto the moving web and reduces any coated waste. Such catch pan configuration, as with other pan configurations, was found to not completely control the liquids adjacent to the edge guides during the catching of the curtain material before and during retraction of the catch pan. Therefore, efficient use of the curtain coating method for manufacturing, for example, photographic materials has thus far been adversely affected by the inability to develop efficient coating start-ups and shutdowns at the intended coating flow rate and web speeds, and control of the liquids adjacent to the edge guides, especially when the edge guides include the use of well known stripping or flushing liquids.

SUMMARY OF THE INVENTION

The present invention is directed to a catch pan for use in apparatus for the curtain coating of an advancing web, film, paper, or other support or object with one or more layers of, for example, photographic material or any other suitable material. The catch pan is useful in controlling the start-up and shut-down of the coating process to prevent the build up of excess coating material on the web, film, paper or other support or object.

According to the present invention, there is provided an improved catch pan for improving the start-up and shut-down of a process for curtain coating a support or object. The apparatus in which the catch pan is useful forms a free falling curtain of one or more layers of coating liquids which falls between first and second edge guides to impinge a moving support or object in a coating zone transverse to the path of movement of the support or object. The catch pan according to the invention comprises a main catch pan surface adapted to be positioned above the support or object in an area between the first and second edge guides for intercepting the falling curtain. The catch pan further comprises resiliently flexible means for engaging and deforming around the first and second edge guides to catch coating liquids in the curtain out to the first and second edges guides and for stripping the first and second edge guides of the coating liquids and any flush water as the catch pan is withdrawn and inserted during start-up and shutdown, respectively.

The invention will be better understood from the following more detailed description and the accompanying drawings and claims.

Figure 3:
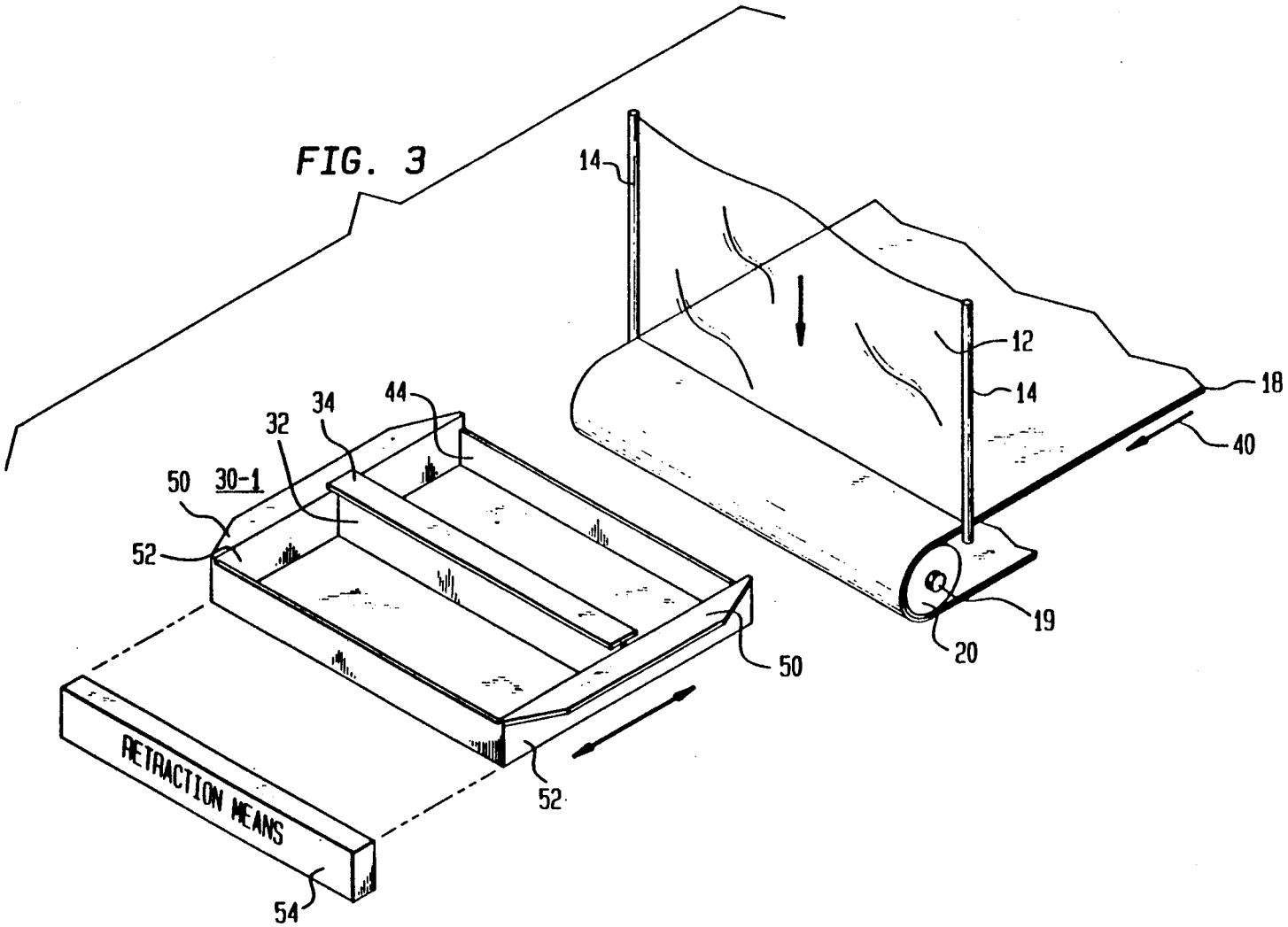
FIG. 3 is a view in perspective of the curtain coating apparatus including a catch pan, comprising, in accordance with the present invention, resiliently flexible means extending from the sides thereof to control edge guide liquids.
Figure 4A:
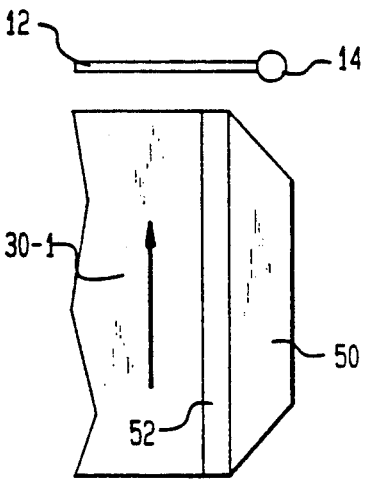
Figure 4B:
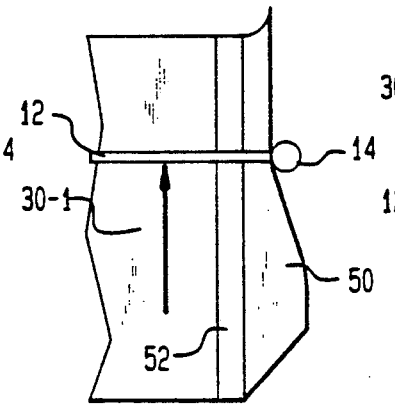
Figure 4C:
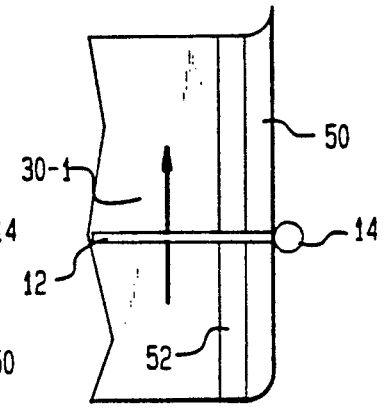
Figure 5A:
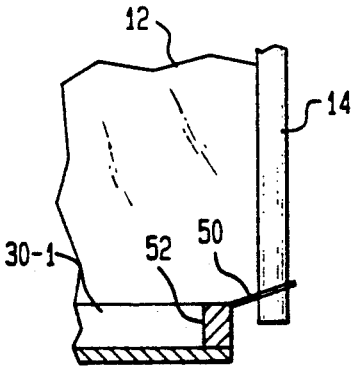
Figure 5B:
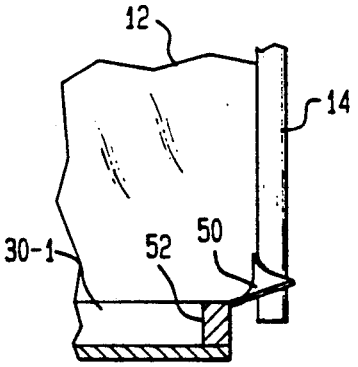
Figure 5C:
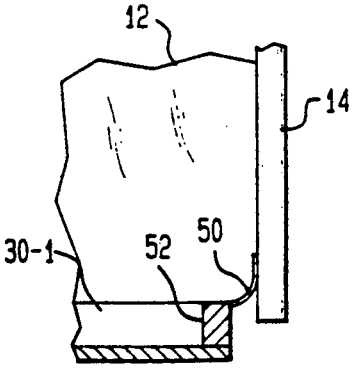
Figure 6:
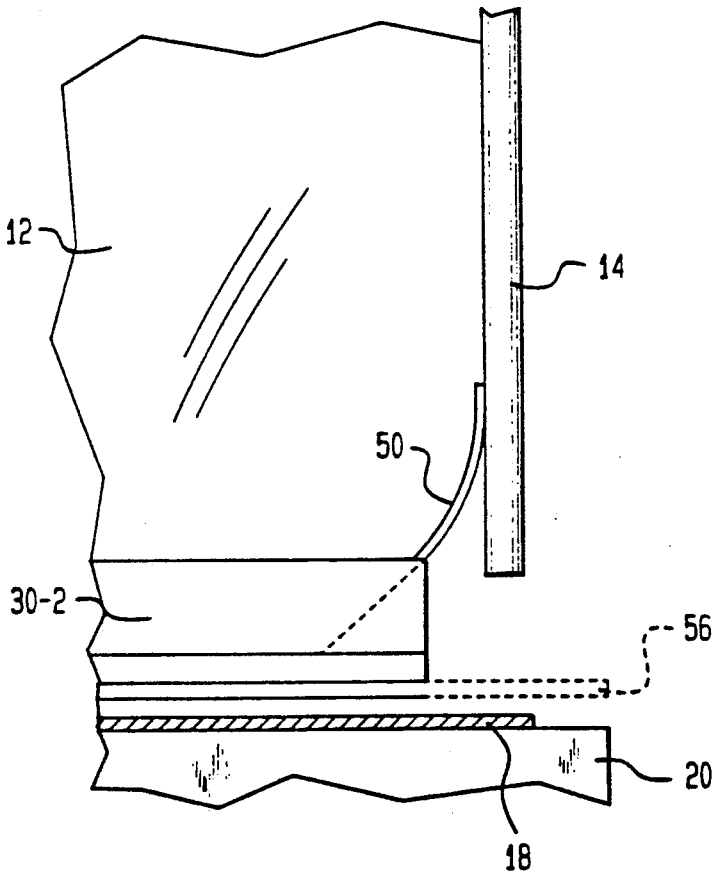

FIGS. 4A, 4B, and 4C are partial top views of a catch pan with the novel side extending resiliently flexible means shown in FIG. 3 in three different stages while being inserted between edge guides during shut-down of the coating process, and while being retracted during start-up of the coating process;

FIGS. 5A, 5B and 5C are partial front views of the catch pan with novel side extending resiliently flexible means in corresponding stages of FIGS. 4A, 4B and 4C, respectively; and FIG. 6 is an enlarged partial front view of the catch pan of FIG. 3 with both a novel resiliently flexible means extending from the top of the catch pan side in upwardly flexed contact with the edge guide, and a novel extension projecting below and beyond the base of the edge guide from the bottom of the catch pan side, in an embodiment appropriate for in board edging.

The drawings are not necessarily to scale.

DETAILED DESCRIPTION

Figure 1:
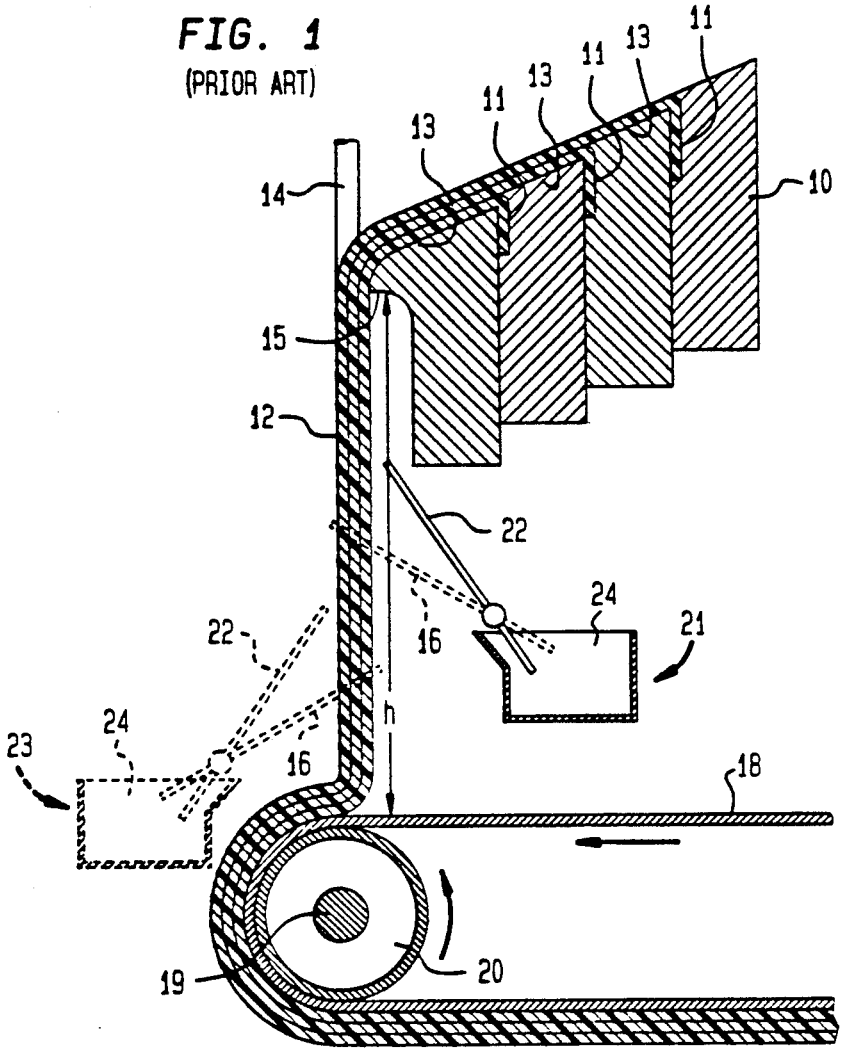
FIG. 1 (PRIOR ART)
FIG. 1 is a side elevation of a prior art curtain coating apparatus of a slide hopper type showing a free falling curtain of liquid held by edge guides impinging on a downwardly inclined start-up deflector positioned near the coating roller during start-up of the coating process.

FIG. 1 shows a prior art multilayer curtain coater of a slide hopper type as shown in U.S. Pat. No. 3,508,947. Three separate coating liquids are delivered to a slide hopper 10, ascend to associated exit slots 11, and are deposited in a form of a layer on the individual associated inclined surfaces 13. Under the effect of gravity, the individual layers flow down the associated surfaces 13, flow over one another and to the coating edge 15 where a free-falling curtain 12 of the three distinct layers is formed. The free-falling curtain 12 thus formed drops over a height "h" and impinges onto a continuously advancing web 18 to form the layers thereon. It is to be understood that the free-falling curtain can comprise photographic coating compositions or any other suitable coating liquid compositions for forming layers on a support or object.

After the line where the multilayer curtain 12 impinges web 18, the web 18 is preferably guided onto and around a coating roller 20. The width of coating roller 20 can be narrower or wider than the width of the web 18 being guided around it, as is well known in the art. The coating roller 20 is mounted on a shaft 19 and can, but not necessarily, be driven by a motor which is not shown.

The free-falling liquid curtain 12 is guided in its free fall at its edges by two edge guides 14 disposed behind each other in FIG. 1, of which only the rear edge guide 14 is shown. The edge guides 14 are vertically arranged and act to hold the edges and stabilize the free-falling curtain before the curtain 12 impinges on the web 18. The edge guides 14 are spaced apart a distance greater than the width of the web 18 to be coated, as may be seen in FIG. 3. FIG. 1 shows how a prior art start-up deflector 16, 22 can be pivoted into place from the non-engaging position 22 with the curtain 12 to the engaging position 16 to intercept the free-falling curtain 12. In engaging position 16, the coating liquids from the free-falling curtain 12 flow down the sloping surface of the start-up deflector and into a catch pan 24. After the free-falling curtain 12 has been stabilized, and the web support 18 brought up to the proper coating speed, the curtain start-up deflector 16, 22 is retracted into the non-engaging position 22 until the free-falling curtain 12 impinges on the moving web 18 supported by coating roller 20. The curtain deflector 16, 22 is retracted in a direction which is both upwards and either opposite or in the direction of travel of moving web 18, depending on its position 21 or 23 relative to curtain 12.

The start-up deflector 16, 22 usually is positioned as close as possible to the coating roller 20 giving due consideration to the downward inclination of the deflector in position 16 and the orientation of container 24. Practical considerations limit the downward inclination angle of the deflector 16 shown in FIG. 1 to an angle of from 10° to 35° relative to horizontal. At angles in this range, the coating liquids will tend to accumulate and form a puddle in the area where the free-falling curtain 12 impinges the deflector 16, 22 surface. For inclination angles less than 10°, the puddling and splashing generated by the curtain liquid impinging on deflector 16 surface is so severe that the free-falling curtain 12 cannot be allowed to fall on the catch pan 24 for more than one to two seconds or else spillage will occur. Also, when the FIG. 1 deflector 16 is retracted to the non-engaging position 22 during start-up, the inertia of the liquid on the retracting deflector 16, 22 will cause the liquid to be partially spilled onto the moving web 18.

Another problem with the curtain coater illustrated in FIG. 1, is that when the curtain deflector 16, 22 is disposed in position 21 and is retracted in a direction opposite to the direction of web 18 travel, the free-falling curtain 12 will be deposited on the web 18 prior to the coating application zone. The pre-coating of the web 18 on start-up results in additional excess coating liquid on the web 18 at start-up and adversely affects the coating at the normal coating zone. The presence of such pre-coatings results in an inability for the curtain 12 to uniformly wet the web 18 and causes air entrainment between the coating layer and the prewetted web 18, which shows up as a coating defect commonly referred to as "wetting failure".

Figure 2:
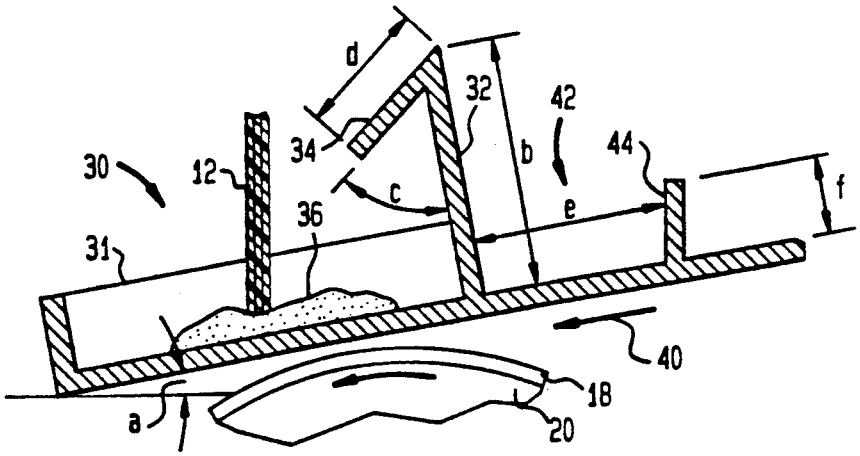
FIG. 2 (PRIOR ART)
FIG. 2 is a side cross-sectional view of a prior art catch pan configuration for catching the falling liquid curtain during start-up of a curtain coating process.

FIG. 2 illustrates a prior art catch pan 30 disclosed in U.S. Pat. No. 4,851,268 that retains excess coating liquids which could not be satisfactorily retained by the deflector 16, 22 of FIG. 1. An exemplary arrangement of the known catch pan 30 comprises a primary lip 32 and a secondary lip 44 which are attached to the trailing end of catch pan 30. The required height "b" of primary lip 32 depends on parameters such as (1) the speed of retraction of catch pan 30, (2) the volume of accumulated excess coating liquids, (3) the angle of inclination "a" of the pan, (4) the flow rate of the curtain liquids, and (5) the length of time the curtain 12 is allowed to impinge onto the catch pan 30 surface. The required height of the primary lip 32 can be reduced by including a lip extension 34 inclined at an angle "c" to lip 32 as illustrated in FIG. 2.

The primary lip 32 retains the excess coating liquid illustrated as puddling liquid 36, which results from the free-falling curtain 12 impinging on the catch pan 30. Catch pan 30 during the start-up process is positioned in close proximity to the moving web 18, supported by coating roller 20, and is retracted in the same direction as the moving web 18 as noted by the direction of arrow 40. Before the retraction of catch pan 30 is started, the point of impingement of the falling curtain 12 onto the catch pan 30 is positioned a predetermined distance from primary lip 32. This distance depends on the time it takes for the catch pan 30 to accelerate to a constant retraction speed. As the catch pan 30 is retracted during start-up, the puddling area 36 is moving towards primary lip 32, and primary lip 32 acts to restrain puddle 36 from being deposited on moving web 18. Continued retraction of the catch pan 30 will eventually cause the primary lip 32 to interrupt falling curtain 12 while the catch pan 30 still completely contains puddle area 36.

Continued retraction of the catch pan 30 creates a second source of excess coating liquids to be contained by the catch pan 30. More particularly, when primary lip 32 penetrates the free-falling curtain 12, further retraction of pan 30 causes the falling curtain 12 to attach to primary lip 32 causing the falling curtain 12 to pull away from its vertical position. Eventually the curtain 12 breaks and the extended curtain 12 liquids are deposited on the catch pan 30 as a heavy puddle in pan extension area 42 of catch pan 30. The height of secondary lip 44 is less than primary lip 32 since it needs only retain the extended curtain material. Preferably, the height "f" of secondary lip 44 should be as small as possible since this secondary lip 44 also tends to create a second curtain extension. The length "e" of pan extension 42, and height "f" of secondary lip 44 will depend on the speed at which catch pan 30 is retracted during start-up. These dimensions also depend on the time it takes for the extended curtain to release from primary lip 32. Because of its configuration, the catch pan 30 can be kept in close proximity to the moving web 18 so as to avoid any additional excess coating liquids associated with a second curtain extension by secondary lip 44 as the catch pan 30 is completely retracted.

Although the catch pan 30 configuration shown in FIG. 2 overcomes most of the problems of start-up deflector 16, 22 of FIG. 1, the configuration of catch pan 30 of FIG. 2 does not sufficiently control the liquids adjacent to the edge guides 14 during retraction or extension of catch pan 30 through the free falling curtain 12. Supplemental complex vacuum systems located on the upper side edges of the catch pan 30 were found to be ineffective to sufficiently control the liquids adjacent the edge guides 14. Therefore, a problem still remained to provide a simple and efficient technique for removing liquids from adjacent the edges guides 14 during start-up and shut-down of the coating operation and prevent spillage onto the web 18 or coating roller 20.

Referring now to FIG. 3, there is shown a catch pan 30-1 in accordance with the present invention which is used with a portion of the curtain coater of FIG. 1. Catch pan 30-1 provides an effective way to strip the liquids from the edge guides.

As shown in FIG. 3, a curtain 12 of a liquid is falling between opposing edge guides 14 onto a web 18 moving in a direction 40 around a roller 20. The catch pan 30-1 is shown positioned in a non-engaging position to allow the free-falling curtain 12 to impinge web 18 and achieve the coating of web 18. Catch pan 30-1 includes the primary and secondary lips 32 and 44 shown in FIG. 2, and also comprises a resiliently flexible means hereinafter referred to as a first and a second thin flexible shims 50 that are shown as extending laterally out from the upper edges of opposing sides 52 of catch pan 30-1 in accordance with the present invention. Shims 50 comprise a thin flexible material and are arranged outward from sides 52 to engage the inboard portion of edge guides 14 and deflect upward to strip the edge guide liquids when catch pan 30-1 is disposed to intercept curtain 12 during start-up or shut-down of the coating process. Additionally, the shims 50 extend along a major portion of the sides 52 to cover at least the distance from adjacent the secondary lip 44 to slightly beyond the area where curtain 12 flows into catch pan 30-1 when catch pan 30-1 is fully inserted during shut-down. The catch pan 30-1 is moved back and forth by, for example, pneumatic or electric actuation using a retraction means 54.

Shims 50 can comprise any thin resilient flexible suitable material such as, for example, a plastic material with exemplary thicknesses of 0.003 to 0.010 inches or metallic material such as stainless steel with, for example, a 0.002 inch thickness. Shims 50 extend outwards from sides 52 of catch pan 30-1 a distance which exceeds the distance between catch pan 30-1 and edge guide 14 by, for example, 0.5 inches of other suitable dimension. It is preferable that the leading and trailing edges of shims 50 be angled or curved away from the edge 52 of catch pan 30-1 at angles which are not so great that the shims snag on the edge guides during relative movement of the pan and edge guides but, also, are not so small that the leading and trailing edges are so long as to make the catch pan 30-1 undersirably long. In one embodiment of the present invention, in which the shims are formed of polyester with 5 mil thickness, the angles are 30°. The shims 50 are forced against, and deform around, the associated edge guide 14 by movement of the catch pan 30-1 as is shown in FIGS. 4A, 4B and 4C, and 5A, 5B and 5C. The shims 50 are designed to minimize web and coating roller contamination by stripping liquids from the edge guides 14 and directing these liquids into the catch pan 30-1 during start-up and shut-down of the coating process.

FIGS. 4A, 4B and 4C, and 5A, 5B and 5C, illustrate corresponding top and front views, respectively, of three stages of the operation of shims 50 as catch pan 30-1 is moved to intercept curtain 12 during shut-down of the coating operation. In FIGS. 4A and 5A, catch pan 30-1 is being moved towards edge guides 14 to intercept the curtain 12. At this stage, shim 50 is extending out from catch pan edge 52 by a predetermined amount that exceeds the normal distance between catch pan edge 52 and edge guide 14. In FIGS. 4B and 5B, catch pan 30-1 has moved adjacent edge guide 14 to begin intercepting curtain 12. At this stage, shim 50 has engaged edge guide 14 and is being flexed upward along a portion of its length. The curtain coating liquids adjacent to the edge guide 14 are now being directed down the upwardly flexed shim portion and into catch pan 30-1. In FIGS. 4C and 5C, the catch pan 30-1 has moved sufficiently to cause shim 50 to be flexed upward along its entire length while engaging the edge guide 14. It is to be understood that both similar and opposite sequences occur when the catch pan 30-1 is moved in similar and opposite directions compared to FIGS. 4A, 4B and 4C, and 5A, 5B and 5C, prior to and during start-up of the coating process.

It is to be understood that contact of the edge guides 14 with a thick (e.g., greater than an exemplary 0.0075 inches) plastic shim 50 material was found to cause liquids to accumulate along the top edge of the shim 50 and eventually flow onto the backside of the edge guide 14. Since cleaning of the edge guides 14 after the coating start is not practical, the liquids would eventually drip from the edging equipment and contaminate the product. The thin shims 50 were found to be very effective for stripping the liquids from the edge guides 14. However, the stripping of the liquids was found to cause the non-water flushed portions of the edge guides 14 to dry out, making reformation of curtain 12 difficult. Failure of the curtain 12 to reform upon removal of the shims 50 is unacceptable, due to excess coating thickness which results from coating of the "narrow" curtain. The impact of drying the edge guide 14 surface during the coating start-up sequence can be minimized by (1) increasing the edge guide water flush flow rate; (2) starting curtain reformation as soon as possible during the start-up sequence; (3) contacting the edge guide 14 as low as possible with the shim 50 material; and (4) minimizing the time of contact of the shim 50 with the edge guide 14. Although the first item above enhances edge guide wetting, it also increases the likelihood of web 18 or coating roller 20 contamination by edge guide water prior to the start of coating. The start of curtain reformation on the protected section of the edge guides is controllable by the geometry of the shims 50 added to the sides 52 of catch pan 30-1. In addition to the criteria described above for determining the angling and/or curvature of the edges of the shims, the angling and/or curvature should also be such that edge guide wetting should occur simultaneously with formation of the curtain wetting line on the web. In this way the curtain 12 rewets the edge guide 14 just prior to the start of coating. The shape of the leading and trailing edges of each of the shims 50 serves to effectively and smoothly vary the force of the shims 50 on the first and second edge guides 14. The rewetting of edge guide 14 occurs once the shim 50 fails to contact the edge guide 14, and results in a full width curtain wetting line at the start which minimizes excess density at the edges of the coating start.

The concern of edge guide 14 rewetting at the start of coating increases as the flow rate of the curtain 12 is reduced. Limited data suggests that curtains 12 of a flow rate less than 6 pounds/minute per foot of width may be plagued by this concern. To minimize this problem, the height of the curtain 12 interception along the edge guide 14 should be minimized to utilize the momentum of the curtain 12 to aid edge guide rewetting. In addition, minimization of the time (less than 1–2 seconds) of the stripping of the liquids from the edge guides 14 reduces the likelihood of excessive edge guide drying and the resultant edge guide rewetting concerns. Additionally, the shims 50 are flushed by the edge guide 14 water stripped from the edge guides, which prevents liquids from collecting on the shims 50 and contaminating the edge guides 14. Standing waves in the curtain 12 have not been observed as a result of contact of the edge guides 14 with the shims 50 or associated edge guide contamination.

Referring now to FIG. 6, there is shown a catch pan 30-2 in accordance with the present invention, intended for inboard edging, that is, the width of the coating is less than the width of the web, and, for this purpose, the edge guides are spaced apart a distance less than the width of the web. The catch pan 30-2 can be used to prevent liquids adjacent to an edge guide, which may not be stripped by shims 50, from contaminating the web 18 prior to the start of the coating process. Catch pan 30-2 is very similar to catch pan 30-1 of FIG. 3 and comprises shims 50, as described hereinabove, and, in addition, an optional extension means 56, shown by dashed lines, which is attached to, and projects outward from, for example, the bottom edge of each of sides 52 of catch pan 30-2. Such extension means 56 can comprise a plastic or metallic material which is preferably thicker than shims 50, and can have some flexibility to avoid damaging web 18 and coating roller 20. The extensions means 56 is positioned for movement beneath the associated edge guide 14 during the retraction and insertion of catch pan 30-2 with curtain 12. Extension means 56 has a predetermined thickness, of, for example, 0.020 inches, to possess sufficient flexibility to minimize damage to the web 18, coating roller 20, and/or edge guides 14 due to a collision during movement of catch pan 30-2. Such extension means 56 catch any remaining liquids which are not stripped from the edge guides 14 by the shims 50, such as a wetting solution moving either down the outer surface of edge guides 14 beyond the area of shims 50 or out from an inboard slot along the length of hollow edge guides 14 and leaking from that slot below shims 50, and thereby prevent contamination of the web 18 or roller 20 by such liquids.

It is to be understood that the specific embodiments described herein are intended merely to be illustrative of the spirit and scope of the invention. Modifications can readily be made by those skilled in the art consistent with the principles of this invention. For example, a catch pan for removing edge guide liquids and preventing contamination of the support 18 during start-up and shut-down may be in the form of, for example, a flat catch pan without primary and secondary lips 32 and 44 of FIG. 2.

What is claimed is:

1. A catch pan for improving the start-up of an apparatus for curtain coating a support, said apparatus being of the type including means for conveying said support along a path through a coating zone extending transversely to said path; means for forming a layer of coating liquid; means for forming a free-falling curtain from said layer within said coating zone, said curtain having transversely spaced edges and impinging on said support; and edge guide means at each of said edges for stabilizing said curtain before said curtain impinges on said support, said catch pan comprising:

a catch surface adapted to be positioned above said support in said coating zone for intercepting said curtain; and resiliently flexible means, attached to and outwardly extended from said catch pan, for engaging and deforming around said edge guide means and deflecting upward to catch coating liquids moving downward in said curtain out to said edge guide means and for stripping said edge guide means of coating liquid moving downward, as said catch pan is stationary within said coating zone, or is withdrawn and inserted during start-up and shut-down, respectively.

2. A catch pan according to claim 1, further comprising retracting means for moving said catch pan out of engagement with said curtain during start-up.

3. A catch pan according to claim 2, wherein said retracting means is also capable of moving said catch pan into engagement with said curtain during shut-down of said apparatus to intercept said curtain and strip liquids from said edge guide means without any substantial deposition of excess coating liquids on said support.

4. A catch pan according to claim 1, wherein said resiliently flexible means comprises leading and trailing edges which are angled to vary the force of said resiliently flexible means on said edge guide means during shut-down and start-up.

5. A catch pan according to claim 1, further comprising extension means associated with said catch pan and adapted to protrude outwards beneath the bottom of said edge guide means without contacting said support, for protecting said support from contamination by any liquid not stripped by said resiliently flexible means during start-up and shut-down of said apparatus.

* * * * *